United States Patent [19]

Belin et al.

[11] Patent Number: 4,519,195

[45] Date of Patent: May 28, 1985

[54] HELICAL WRAPPING OF TAPE

[75] Inventors: Rudolf E. Belin, Freshwater Creek; William F. Boyce, Buckley; John D. Feehan, Belmont, all of Australia

[73] Assignee: Commonwealth Scientific and Industrial Research Organization, Campbell, Australia

[21] Appl. No.: 524,502

[22] Filed: Aug. 18, 1983

[30] Foreign Application Priority Data

Aug. 18, 1982 [AU] Australia ..... PF5453

[51] Int. Cl.[3] ..... D02G 3/36; D02G 3/06; D02G 3/08; D02G 3/40

[52] U.S. Cl. ..... 57/3; 57/6; 57/7; 57/12; 57/31; 57/32; 57/352

[58] Field of Search ..... 57/3, 6, 7, 31, 352, 57/32, 12, 13

[56] References Cited

U.S. PATENT DOCUMENTS

| | | | |
|---|---|---|---|
| 1,888,033 | 11/1932 | Frank | 57/32 X |
| 2,213,659 | 9/1940 | Vincke | 57/31 X |
| 3,091,075 | 5/1963 | Hamilton | 57/32 |
| 3,122,873 | 3/1964 | Lancaster et al. | 57/32 |
| 3,126,699 | 3/1964 | Lefevre et al. | 57/31 X |
| 3,193,904 | 7/1965 | Evans et al. | 57/31 X |

*Primary Examiner*—John Petrakes

*Attorney, Agent, or Firm*—Sughrue, Mion, Zinn, Macpeak & Seas

[57] ABSTRACT

A system for helically wrapping a tape comprises tape twisting means, and, upstream of the twisting means, means for shaping the tape. The shaping means comprises a body over which the tape passes, the body having a first surface of at least partially cylindrical form and an outwardly curved edge surface extending along a side of the first surface. Tape supply means is arranged to feed the tape onto the first surface such that the tape is inclined to a plane at right angles to the axis of the first surface whereby an edge of the tape engages the curved edge surface and is thereby shaped in order to initiate wrapping. The system is particularly suitable for wrapping a paper tape around a nylon core.

8 Claims, 5 Drawing Figures

HELICAL WRAPPING OF TAPE

BACKGROUND OF THE INVENTION (1) Field of the Invention

This invention relates to a system for the formation of a continuous, cylindrical, elongate body composed of a resilient tape-like material which is helically wrapped to generate the cylindrical body. The wrapping may be carried out to generate a hollow body or may be executed in conjunction with a solid continuous cylindrical or filamentous core member to cause the core member to become helically wrapped in, and therefore sheathed by, the tape-like material.

(2) Description of the Prior Art

The wrapping of continuous elongate bodies, such as wires, cables and ropes, is well known and uses a wide variety of materials and wrapping geometries and techniques. For example it is well known to wrap electrical cables with paper tape for insulating purposes by employing planetary reels adapted to lay the paper tape helically, with or without overlap, so as to provide one or more layers of insulation. Generally additional agents are employed such as glues, sizes and varnishes.

However in some applications, particularly those not involving the paper tape primarily as an electrical insulator, the wrapping of a filament core with paper tape is highly desirable for a number of reasons. For example, during the past twenty years or so there have been a number of efforts made to manufacture woven fabric for wool bales from materials which would overcome the problem of contamination of wool by these materials. This objective can be achieved if these materials are either removed in the processing or do not show as faults in the finished wool fabric. Nylon is a material which accepts wool dyes and if it is in the form of a fine filament it is not visible as a fault in the wool fabric. Paper is another material which does not become a contaminant as it is removed in processing.

Wool bales have been woven from nylon multifilament yarns but they suffer from several disadvantages. A nylon pack which has just sufficient tensile strength to meet the extreme stresses encountered in dumping tends to stretch under the relatively low levels of stress which exist when it is fully loaded and hence bulges unduly. Using appreciably higher fabric weights of nylon overcomes the bulging problem but then the cost becomes prohibitive. Moreover nylon's low coefficient of friction leads to difficulties in stacking the loaded bales due to the tendency of the bales to slip and topple.

Wool bales have also been woven from twisted paper yarn, but because of its low tensile strength, it must have a high linear density with the result that a bale to meet the required strength becomes heavy and stiff. However, it does have the required stiffness characteristics for good shape retention.

Due to the perceived non-contaminating advantages in weaving bale fabrics from paper/nylon composite yarns, namely the potential to combine the high strength of nylon multifilament with the high stiffness of paper, one of the present inventors has described the results of investigations carried out to this effect; see R. E. Belin, "Wool Packs made from a Paper/Nylon Wrap Yarn", *Textile Institute and Industry,* (Aug. 1981), pp. 229–230. This yarn comprised a nylon core around which a paper tape was helically wrapped so that each turn overlapped the previous one to ensure complete coverage of the core. This was achieved using a standard flyer cone rover modified by the removal of the drafting units and with the addition of creels for nylon and for paper, means for moistening the paper tape and a yarn forming device. However, special provision of means to deliver the paper under constant tension was required and the yarn forming device was difficult to thread. In addition, yarn production rate/spindle was low, about 15 m/min., because of the limitation in twisting speed of this type of machine.

SUMMARY OF THE INVENTION

According to the present invention, there is provided a system for helically wrapping a tape comprising, tape twisted means, and, upstream of the twisting means, means for shaping the tape, said shaping means comprising a body over which the tape passes, said body being defined by the locus of a line moved at least partially around an axis, said line comprising a first portion extending generally parallel to said axis and an arcuate portion extending from an end of the first portion in a direction away from said axis, whereby said first portion defines a first surface of at least partially cylindrical form and said second portion defines an outwardly curved edge surface extending along a side of the first surface, and tape supply means for feeding the tape onto the first surface such that the tape is inclined to a plane at right angles to the axis of the first surface whereby an edge of the tape engages the curved edge surface and is thereby shaped in order to initiate wrapping.

A preferred embodiment of the invention overcomes the difficulties discussed earlier in connection with the fabrication of paper/nylon composite yarns by providing a helically shaping means in the form of a three-dimensional curved body as defined above and a positive paper feed which together obviate the need for the complex tensioning devices as previously proposed. Continuous helical wrapping is achieved by using a ring twisting frame to insert twist and hence torque into the paper/nylon yarn. It is this torque which equates to the force required to wrap the tape around the nylon filament as the nylon and tape pass over the three dimensional curved guide surface. By this technique wrapped yarns can be produced up to or even greater than 50 m/min-the level being determined by the maximum permissible linear speed of the traveller. It must be stressed that the operation is not restricted to the use of a ring twister; a flyer or other twisting machine can alternatively be used.

The invention is readily adaptable to the production of hollow paper and like-composed small diameter continuous tubular products. It can also be used to helically wrap wires such as electrical conductors for communication purposes, in which provision must be made to prevent the twisting of the core. Thus, in general terms, the system of the invention can be used to cylindrically wrap a tape about itself or around a core of filaments, wire, cord or the like, by means of the three dimensional curved shaping body around which the tape and filament converge at a point where the tape wraps around the filament by virtue of the torque inserted into the wrapped yarn by the rotation of a spindle and a traveller which carries the yarn around the spindle.

Preferably the system includes means for feeding the core and the tape to the point of convergence on the three dimensional curved shaping body where the tape wraps around the core, core guiding means, and means for twisting and winding up of the wrapped core onto a package. To achieve the last two means a conventional downtwister may be used.

Conveniently the tape supply means may comprise a pair of rotating nip rollers, with core guiding means in the form of a ceramic eyelet. The twisting means can be a conventional ring downtwister wherein twist is inserted into the wrapped core by means of a traveller taking it around a rotating spindle carrying a tube or bobbin onto which the wrapped core is wound, wrapped tape guiding means being provided in the form of conventional ceramic pig-tail guide. It is to be understood that other tape supply means, other core guiding means, other twisting means, and other wrapped core guiding means can be used.

BRIEF DESCRIPTION OF THE DRAWINGS

An embodiment of the invention will now be described by way of example only, with reference to the accompanying drawings in which.

Figure 3:
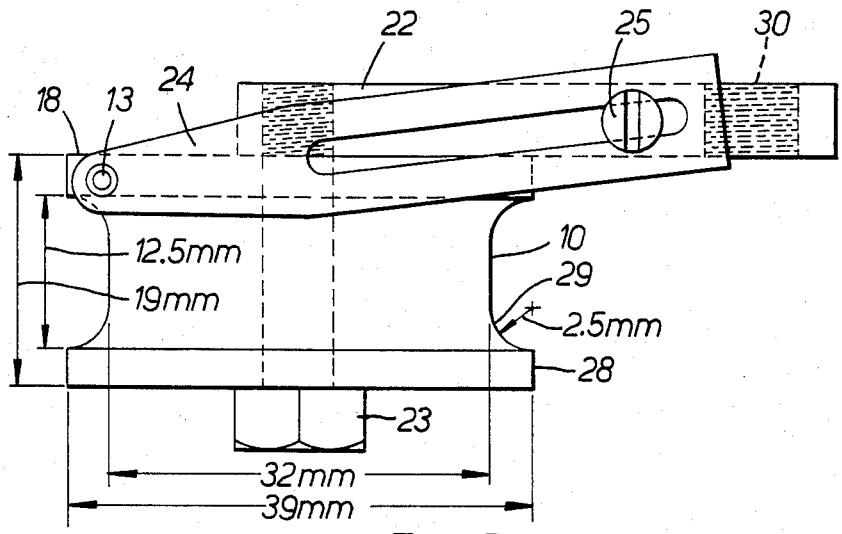

FIG. *2a* is a front elevation of a wrapping capstan of the system set up to provide an S-twist around a nylon core;

FIG. *2b* is a front elevation similar to FIG. *2a* but showing the wrapping capstan set up to provide a Z-twist around a nylon core;

FIG. 3 is a plan view of the wrapping capstan; and

Figure 4:
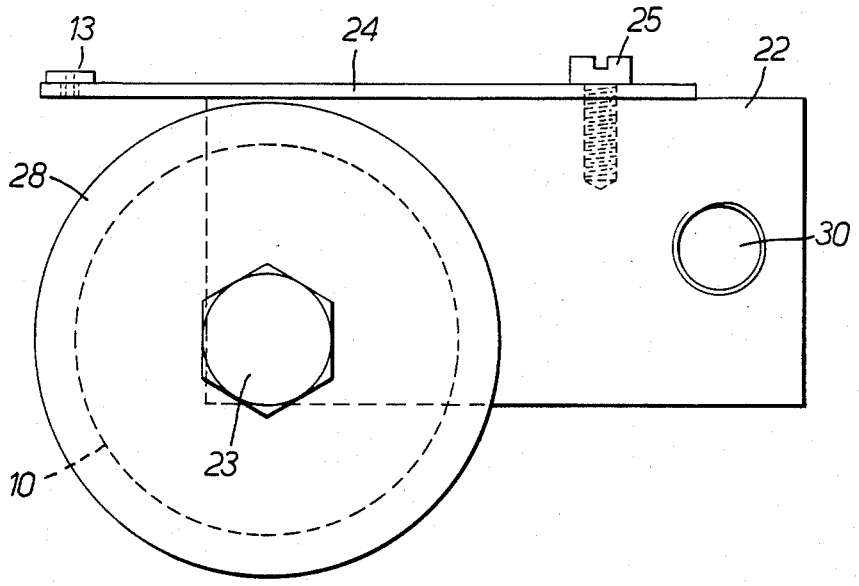

FIG. 4 is a side elevation of the wrapping capstan.

DESCRIPTION OF THE PREFERRED EMBODIMENT

The preferred embodiment will be described with particular reference to the continuous helical wrapping of 5 mm wide 27.5 gsm high wet strength kraft paper about a 940 dtex multifilament nylon core. In this case the paper needs to be made more pliable by applying water. This is conveniently done by allowing the lower roller of the nip roller pair to dip into water containing a wetting agent. Rotation of this roller raises water into the nip zone where some of the water is transferred to the paper. Excess water is removed from the paper by a wiper on each side of the tape and in contact with it.

In order to understand the operation, it is important to understand that the angle of lap, referred to subsequently as the helix angle, is the angle between the line parallel to the axis of the yarn and a line parallel to the edge of the wrapping tape.

Figure 1:
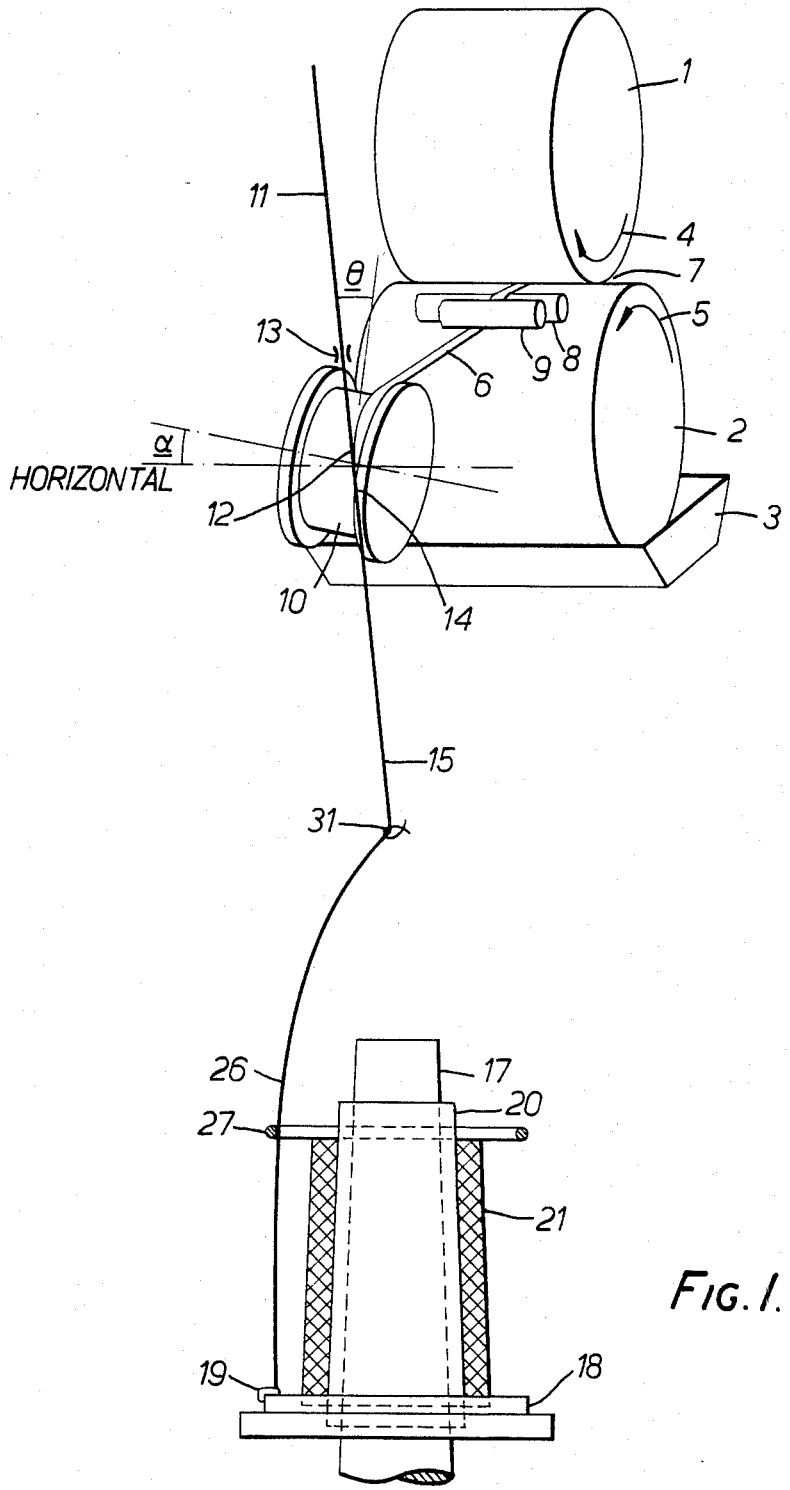
FIG. 1 is a schematic elevation of a wrapping system in accordance with a preferred embodiment of the invention.
Figure 2A:
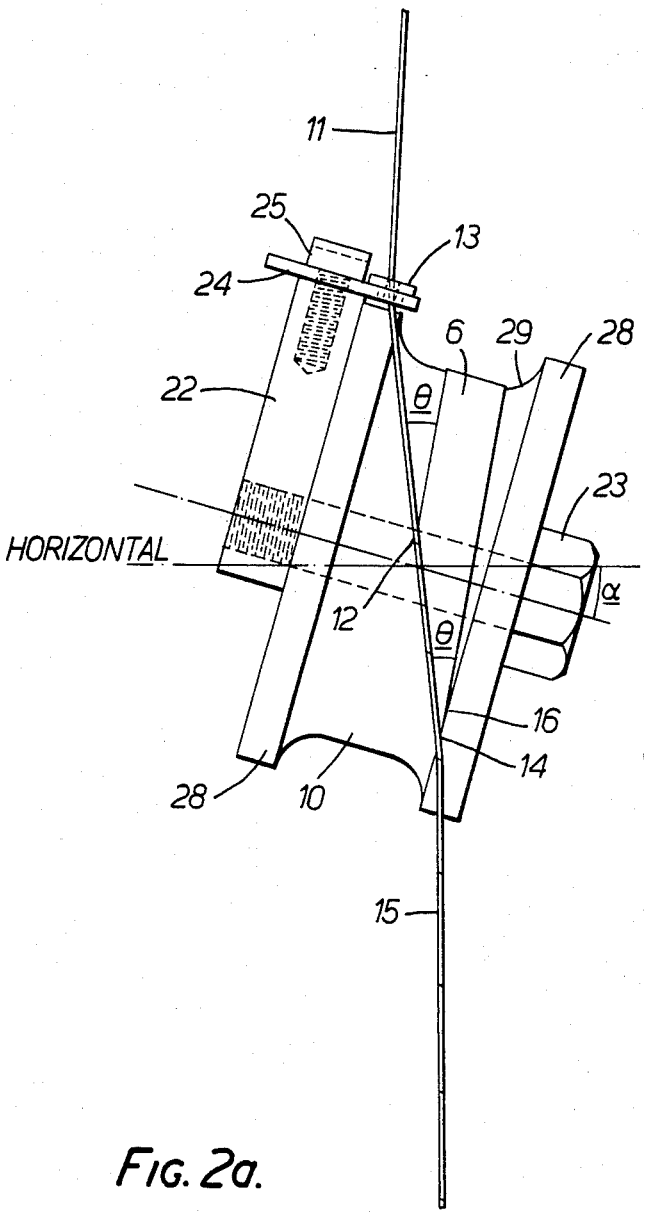
Figure 2B:
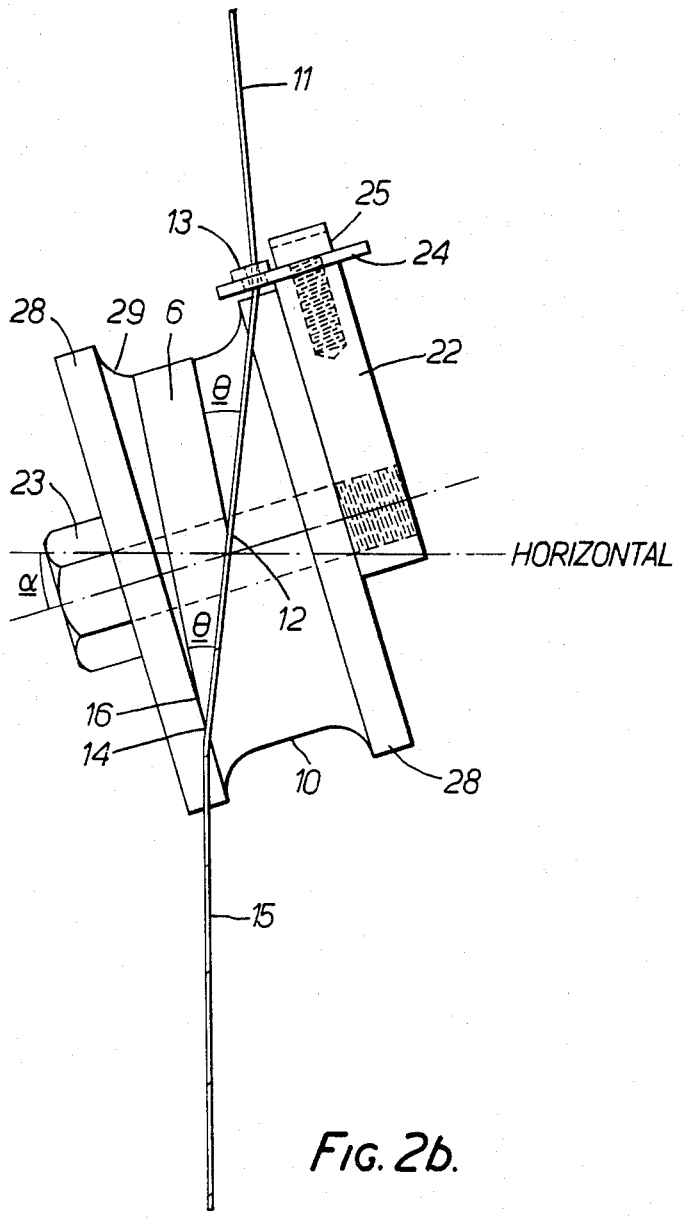

In FIG. 1 two nip rollers 1 and 2 are shown, the lower one of which dips into a wetting bath 3 containing water and a wetting agent. By virtue of their rotation, as shown by the arrows 4 and 5, paper tape 6 is fed forward at a controlled rate and water is raised from the wetting bath 3 to the nip 7 of the rollers. Here the water moistens the tape 6. Excess surface moisture is removed by stationary ceramic wipers 8 and 9, each in contact with a respective side of the tape surface. The tape passes, with its transverse dimension substantially horizontal, from the wipers to shaping means in the form of a wrapping capstan 10, the tape 6 passing approximately 90° around the capstan. During this movement around the capstan 10, the tape 6 converges with a nylon core 11 at a point 12 on a cylindrical surface of the capstan. The nylon core passes under very low tension through a ceramic eyelet 13. At the point 12 the tape 6 begins to wrap helically around the nylon core 11 and wrapping is complete at point 14 at an edge of a cylindrical land 28 of the capstan 10 as will be described later. The bi-component yarn 15, consisting of the tape helically wrapped around the core, then follows a vertical downward path through a pigtail 31, which is axially situated above spindle 17, through the traveller 19 which moves on the ring 18 around the spindle 17, and finally is wound on to a package 20 to form package 21. 26 is the balloon normally formed and 27 the antiballooning ring. The force for wrapping is created by the torque generated in the yarn 15 by rotation of the spindle 17 and the traveller 19. The helix angle of wrapping is given by $\theta$. The wrapping capstan 10 is inclined at an angle $\alpha$ to the horizontal, with its top to the right when, as, shown in FIG. 1, the spindle traveller combination is set for inserting S twist. The point 14 where the wrapping is complete is in line with the centre of the pigtail 31 and the axis of the spindle 17.

Now refer to FIG. *2a* which is a front elevation of the wrapping capstan 10 inclined for the S twist condition referred to in the above paragraph. FIG. *2b* is a front elevation of the wrapping capstan 10 but inclined—top to the left—for the Z twist condition. The description of the wrapping operation given below will be restricted to the S twist condition but applies equally to the Z twist condition. In FIG. *2a* the capstan 10 is fixed to a support member 22 by a bolt 23. The ceramic eyelet 13 referred to above is held by a bracket 24 which is secured to the support member 22 by bolt 25. The capstan 10 is a fixed cylinder around which the tape 6 is drawn by the tension developed in the balloon 26, FIG. 1. The core 11 is shown passing through the ceramic eyelet 13 to converge, tangentially to the cylindrical surface of the capstan 10 at a point, 12, with the paper tape 6. The angle between the core 11 and the tape at point 12 is the helix angle of wrap $\theta$. As shown in FIGS. 3 and 4, the bracket 22 has a hole 30 intended for mounting the bracket 22 to the twisting frame.

It will be noted from FIG. *2a*, that the tape 6 is fed onto the cylindrical surface of the capstan at an angle to a plane at right angles to the axis of the cylindrical surface so that tape approaches a side edge of the cylindrical surface as the tape moves along the cylindrical surface.. This edge of the cylindrical surface merges with a surface 29 which curves outwardly from the axis of the cylindrical surface. The curved surface terminates at the cylindrical land 28, referred to earlier. The point 14 at which wrapping is complete lies at the edge between the curved surface 29 and the land 28. The edge of the tape 6 (the right-hand edge as shown in FIG. *2a*) in passing from the cylindrical surface along the curved surface 29 is shaped by the curved surface 29 to initiate wrapping.

The opposite side edge of the cylindrical capstan surface merges with a similar curved surface 29. This latter curved surface does not take part in the wrapping operation when the capstan is set up as shown. The function of this second curved surface is to enable the capstan to be set up for the Z-twist condition.

Before describing the function of the capstan wrapper in further detail, we will consider first the helical wrapping of a tape of successive turns around a core with no turns overlapping. Uniform wrapping can only be achieved if differential strain between the edges of the tape is avoided, i.e. both edges wrap on to the core at the same helix angle. If successive tape turns around the core overlap each other to give a maximum of, say, two tape thickness then the inner edge will wrap onto a diameter which is two thicknesses of tape less than that which the outer edge wraps onto. This implies that for a uniform wrap with no wrinkles the outer edge will be strained relative to the inner edge and dictates that the tape must have a reasonable degree of extensibility at a low stress. By example, consider the aforementioned 940 d tex multifilament wrapped by a 5 mm wide 27.5 gsm paper at a helix angle of 16°. This results in tape overlap and a differential strain between the inner and outer tape edges. Also the inner edge wraps on at a lower helix angle than the outer edge. To achieve the differential strain condition the paper tape must be saturated with water which increases its extensibility from 2%, measured under standard conditions, to around 7%. The differential strain is usually of this order or greater and in practice is accommodated by some contraction at the inner edge and a certain degree of wrinkling. In the present example for a yarn generation rate of 40 m/min it has been found that high wet strength twisting kraft of dry strength 100 mN/tex and wet/dry strength ratio of 0.3 should have a 60 sec Cobb value (appita AS 1301) in excess of 100 and preferably higher than 300.

Now consider the situations where the angle of inclination $\alpha$ FIGS. 1 and *2a* is zero and the tape merely laps the cylindrical surface 10 of the capstan by 90° and is affected by neither the curved surface 29, nor the land 28. In the absence of a core, a small diameter cylinder is created provided the twist level is not too high to cause collapse radially. However, due to variations in paper thickness and density and hence stiffness and lack of some form of control at the tape edges, the wrapping points are very unstable. In consequence, the cross-section of the paper cylinder is very variable. The presence of a nylon core tends to exacerbate this condition. In practice, the paper tape will not wrap evenly about the core as the point 12 of core-tape convergence 12 moves back and forth. Due to the strains involved, this outer edge has a tendency to curl back to produce an unwanted reverse fold. As the core tension is near zero, it cannot influence these conditions and consequently due to instability at the point 12 of convergence of tape and core, the core has a tendency to jump back and forth from being wrapped by the tape to itself wrapping around the paper cylinder being formed.

With a nylon core, the requirement for low tension is due to its characteristic of high extensibility at low loads. Hence, if the nylon is stressed before wrapping it extends sufficiently to cause problems when allowed to relax after the composite is unwound from the package. The nylon contracts in length and, because of the high stiffness of the paper tape and its helical wrap, unwanted paper loops are formed and the nylon is exposed. This problem is not, however, encountered for low extensibility materials such as Kevlar.

To achieve a satisfactory wrap of cylindrical cross-section and to avoid all the problems previously described, not only must the tape deform readily at low stress but also the capstan wrapper must comply with certain criteria. The necessary geometrical requirements for satisfactory wrapping will now be explained by reference to FIG. *2a*.

For a nylon core tension near zero, the tension of, and the torque in, the paper-nylon yarn at the point of formation must be balanced by forces exerted on the paper tape. This situation exists when the nylon path between the ceramic guide 13 and the point 14 where the outer edge wraps onto the yarn, is essentially in line with the paper nylon yarn path. The low nylon tension barely influences conditions for wrapping, as can be demonstrated by a nylon run out which is seen to produce no noticeable effect in wrapping. Also, for the case where successive tape turns overlap it is essential to pre-strain the right hand side of the paper tape 6, FIG. *2a* prior to wrapping as well as to control this edge to give stable wrapping at 14. This is achieved by means of the curved surface 29.

It follows from the preceding paragraph that the paper tape at the point 12 of convergence with the nylon core must make an angle of approximately, but no greater than, the helix angle $\theta$ to the vertical. This can be achieved by tilting the capstan axis (to the right for S twist) to make an angle $\alpha$ with the horizontal where $\alpha$ is approximately equal to the helix angle but no greater.

The forces involved, when the S-twist conditions prevail, tend to shift the tape path to the right, FIG. *2a*, and up the curved surface 29 between the cylindrical surface, and the land 28, until a stable running position is reached. In so doing the right-hand edge of the paper tape, prior to wrapping, will be strained relative to the left—a necessary condition for good wrapping. A further control preventing movement of the tape to the right is the point 16 where the edge of the tape touches the edge of the land 28 as it leaves the capstan. This point 16 must be near to or at the point 14 FIG. *2a*, i.e. the distance between 16 and 14 should tend to zero to ensure stability in wrapping at the outer edge. This combined with the pre-straining of the paper at the right-hand edge prevents any edge turn back as previously described. In practice, it has been found that if 16 is below 14 a twist barrier is created and wrapping is adversely affected.

For a given helix angle of wrap, the diameter of the cylindrical surface, the radius of curvature 29, the diameter of the land 28, and the angle of tilt of the capstan are all predetermined. For example, for a given helix angle of 16° corresponding to a twist insertion rate of 105 T/m and a final measured yarn diameter of approx. 0.8 mm the optimum geometrical conditions are given in FIG. 3 for a 5 mm wide tape. For any other helix angle, i.e. twist insertion/m the optimum conditions differ although it is possible still to produce a yarn but the angle of tilt must be changed as explained earlier. For example, for a twist insertion rate of 190 T/m corresponding to a helix angle of 22° the cylinder diameter of 32 mm is still acceptable but the radius of curvature, 29, must now be the 4 mm, the land diameter must be 37 mm, and the angle of tilt, $\alpha$ must be approximately 22°.

All the above conditions apply to a tape width of 5 mm. Quite clearly, some modifications are necessary if a different paper tape width is to be used. Also, if the paper tension is raised, conditions become less critical because the paper is more strained but can result in unacceptable levels of paper failures. In general, however, the relationship between the tape width, helix angle, diameter of the surface 10, radius of the curved surface 29, and diameter of the land 28 can be determined empirically.

In the preferred embodiment, wrapping is effected over only a part of the cylindrical surface and curved surface 29 of the capstan. It will therefore be apparent that it is not essential for the wrapping surfaces to subtend 360°. In general terms, therefore, the shaping means of which the wrapping capstan constitutes one embodiment, can be considered to be defined by the locus of a line moved at least partially around an axis, said line having a first portion extending generally parallel to the axis, and an arcuate portion extending from an end of the first portion in a direction away from the axis the first portion thus defines the cylindrical surface (or a portion of a cylindrical surface), and the arcuate portion defines the curved surface 29. The surface generated by the first portion does not need to be exactly cylindrical (or part-cylindrical); it will suffice for the surface to approximate to a cylindrical or part-cylindrical surface.

The embodiment has been described by way of example only and modifications are possible within the scope of the invention as defined in the appended claims.

What is claimed is:

1. A system for helically wrapping a tape comprising, tape twisting means, and, upstream of the twisting means, means for shaping the tape, said shaping means comprising a body over which the tape passes, said body being defined by the locus of a line moved at least partially around an axis, said line comprising a first portion extending generally parallel to said axis and an arcuate portion extending from an end of the first portion in a direction away from said axis, whereby said first portion defines a first surface of at least partially cylindrical form and said second portion defines an outwardly curved edge surface extending along a side of the first surface, and tape supply means for feeding the tape onto the first surface such that the tape is inclined to a plane at right angles to the axis of the first surface whereby an edge of the tape engages the curved edge surface and is thereby shaped in order to initiate wrapping.

2. A system according to claim 1, wherein the tape supply means comprises means for feeding the tape with its transverse dimension directed generally horizontally, and the shaping means is mounted with its axis inclined to the horizontal whereby the tape passes across the first surface onto the curved edge surface, said curved edge surface having a radially outer edge across which the wrapped tape passes substantially vertically to the twisting means.

3. A system according to claim 2, comprising means for feeding a filament about which the tape is wrapped, said filament being fed relative to said first surface such that the filament passes generally tangentially to the first surface, with the axis of the filament being inclined to the axis of the tape on said first surface, wrapping of the tape on said filament occurring before said tape leaves said edge surface.

4. A system according to claim 3, wherein the tape is paper and the filament is nylon, said nylon filament being fed under low tension.

5. A system according to claim 1, wherein the twister is a ring twister.

6. A system according to claim 1, wherein the tape supply means comprises a pair of nip rollers.

7. A system according to claim 1, wherein the tape is a paper tape, said apparatus further comprising means for wetting the tape prior to wrapping,

8. A system according to claim 7, wherein the tape supply means comprises a pair of nip rollers, and the means for wetting the tape comprises means for supplying wetting liquid to the nip rollers.

* * * * *